US007905036B2

(12) United States Patent
Howell

(10) Patent No.: US 7,905,036 B2
(45) Date of Patent: Mar. 15, 2011

(54) HOLDER FOR WEARING BY A USER, SLIDABLY, REPLACEABLY, AND VISIBLY HOLDING AN ID CARD, AND REPLACEABLY AND VISIBLY HOLDING AT LEAST ONE SPECIFICALLY CONFIGURED CHARM

(76) Inventor: Brody Michael Howell, Greenwood, IN (US)

( * ) Notice: Subject to any disclaimer, the term of this patent is extended or adjusted under 35 U.S.C. 154(b) by 0 days.

(21) Appl. No.: 12/221,735

(22) Filed: Aug. 6, 2008

(65) Prior Publication Data

US 2010/0031547 A1 Feb. 11, 2010

(51) Int. Cl.
*A44C 3/00* (2006.01)

(52) U.S. Cl. ..... 40/1.5; 40/775; 40/654.01

(58) Field of Classification Search ..... 40/1.5, 40/1.6, 775, 776, 654.01
See application file for complete search history.

(56) References Cited

U.S. PATENT DOCUMENTS

| | | | | | |
|---|---|---|---|---|---|
| 2,177,406 | A * | 10/1939 | Hacker | 40/1.5 |
| 2,341,773 | A * | 2/1944 | Hanson | 40/1.5 |
| 2,441,002 | A | 5/1948 | Berglund | 40/16 |
| 2,650,444 | A | 9/1953 | Coyle et al. | 40/16 |
| 4,616,435 | A * | 10/1986 | Perfect | 40/6 |
| 5,161,827 | A | 11/1992 | Grosso | 283/77 |
| 5,384,972 | A * | 1/1995 | Arnt | 40/1.6 |
| 5,673,501 | A * | 10/1997 | Mathews | 36/136 |
| 6,226,905 | B1 * | 5/2001 | Osuna | 40/1.6 |
| 6,427,836 | B1 * | 8/2002 | Bolanos | 206/449 |
| D467,965 | S | 12/2002 | Haas | D19/10 |
| 7,257,967 | B2 * | 8/2007 | Rheinstein | 63/40 |

* cited by examiner

*Primary Examiner* — Cassandra Davis
(74) *Attorney, Agent, or Firm* — Bernard S. Hoffman

(57) ABSTRACT

A holder for wearing by a user, slidably, replaceably, and visibly holding an ID card, and replaceably and visibly holding at least one specifically configured charm. The holder includes a frame, a first apparatus allowing the holder to be worn by the user, a second apparatus slidably, replaceably, and visibly holding the ID card, and a third apparatus replaceably and visibly holding the at least one specifically configured charm.

9 Claims, 2 Drawing Sheets

HOLDER FOR WEARING BY A USER, SLIDABLY, REPLACEABLY, AND VISIBLY HOLDING AN ID CARD, AND REPLACEABLY AND VISIBLY HOLDING AT LEAST ONE SPECIFICALLY CONFIGURED CHARM

BACKGROUND OF THE INVENTION

A. Field of the Invention

The embodiments of the present invention relate to a device for holding an ID card, and more particularly, the embodiments of the present invention relate to a holder for wearing by a user, slidably, replaceably, and visibly holding an ID card, and replaceably and visibly holding at least one specifically configured charm.

B. Description of the Prior Art

In this day and age, security is of the utmost importance. Corporations and businesses have long used laminated ID cards as a quick and easy way of identifying a person, as well as a person's clearance for their premises. A quick look at an ID card suspended from a person's neck, pocket, or lapel assures that he/she has been cleared, and that he/she has permission to remain on the premises.

In the past, ID cards have frequently been strung from utilitarian lanyards made of cheap materials, such as ball or beaded chain, and cotton or nylon material. A hook or badge clip is then slipped onto the loop of the lanyard, and the entire device is then suspended from a person's neck. Lanyards are frequently used as a casual way of carrying not only ID tags, but also small and easily suspended items, such as dorm-room keys. Alternatively, a badge clip may also be independently used to suspend an ID card from a piece of clothing, such as a pocket or a lapel, and this approach is favored in many corporations and agencies.

Numerous innovations for badge holders have been provided in the prior art, which will be described below in chronological order to show advancement in the art, and which are incorporated herein by reference thereto. Even though these innovations may be suitable for the specific individual purposes to which they address, however, they differ from the embodiments of the present invention in that they do not teach a holder for wearing by a user, slidably, replaceably, and visibly holding an ID card, and replaceably and visibly holding at least one specifically configured charm.

(1) U.S. Pat. No. 2,441,002 to Berglund.

U.S. Pat. No. 2,441,002 issued to Berglund on May 4, 1948 in class 40 and subclass 16 teaches an employee badge including a first apertured plate including two bonded transparent plastic laminae and an opaque first sheet bearing indicia bonded between the laminae. The sheet terminates along one edge in substantially spaced relation from the adjacent edge of the bonded laminae providing an extensive transparent zone in the laminae. A second registeringly apertured plate includes two similar laminae and an opaque second sheet bearing indicia bonded therebetween. A detachable fastening apparatus for clamping the plates together with the second plate is disposed behind the first plate, with the second sheet indicia behind the transparent zone. The fastening apparatus is disposed in the registering apertures and includes a button at the front end thereof interchangeable with other similar buttons. The button is of a color contrasting with the background of the badge surrounding the apertures.

(2) U.S. Pat. No. 2,650,444 to Coyle et al.

U.S. Pat. No. 2,650,444 issued to Coyle et al. on Sep. 1, 1953 in class 40 and subclass 16 teaches a display card holder including a sheet of transparent, elastomeric, and waterproof material having an edge portion doubled over and integrally bonded to opposing portions of the sheet to define a generally rectangular and water-tight pocket opening upwardly of the holder. A second sheet of the material defines with the first sheet a second generally rectangular and water-tight pocket opening downwardly of the holder. The second sheet has an edge portion closing the opening of the first pocket and defining with the doubled-over portion the opening of the second pocket. The doubled-over portion and second sheet have overlapping side edge portions secured together in an integral lower edge portion of the second sheet.

(3) U.S. Pat. No. 5,161,827 to Grosso.

U.S. Pat. No. 5,161,827 issued to Grosso on Nov. 10, 1992 in class 283 and subclass 77 teaches a transparent insert holder adapted to receive and protect cards, such as photographs, permits, and the like. The insert holder includes first and second four-edged plastic cover sheets for forming front and back surfaces of the insert holder. The first plastic cover sheet has a predetermined-sized transparent window therein defined by a surrounding non-transparent area. A four-edged, double-sided frame is positioned between the first and second plastic sheets for securing the first and second sheets to opposing front and back sides of the frame to form the holder. The frame has a pressure sensitive adhesive coating on its front and back surfaces. The first cover sheet is secured to the frame by the pressure-sensitive adhesive to completely enclose one of the front and back surfaces of the frame. The second cover sheet is secured to the other one of the front and back surfaces of the frame along a first edge segment of the frame and unattached to a second edge segment of the frame whereby the second cover sheet is hinged to the frame to form a flap covering the frame, which can be flexed away from the frame to insert a card thereunder and into the frame opening. A release liner apparatus covers the adhesive on the second edge segment of the frame and is covered by the second cover sheet to protect the adhesive until assembly of the frame in the cover sheets.

(4) U.S. Pat. No. 5,673,501 to Mathews.

U.S. Pat. No. 5,673,501 issued to Mathews on Oct. 7, 1997 in class 36 and subclass 136 teaches an article of footwear, which includes a shoe with a sole and an upper, a toy element, and a snap attachment assembly including cooperating male and female components. The female component is attached to the shoe. The cooperating male component is attached to the ornamental article, which is thus removably assembled with the shoe by cooperative snap engagement of the female and cooperating male components of the snap attachment assembly. In preferred embodiments, one or several ornamental articles are interchangeably displayed on shoes and on fashion display accessories, e.g., bracelets, barrettes, chains, and pendants.

(5) U.S. Pat. No. D467,965 S to Haas.

U.S. Pat. No. D467,965 S issued to Haas on Dec. 31, 2002 in class D19 and subclass 10 teaches an ornamental design for a security pass.

(6) U.S. Pat. No. 7,257,967 B2 to Rheinstein.

U.S. Pat. No. 7,257,967 B2 issued to Rheinstein on Aug. 21, 2007 in class 63 and subclass 40 teaches a fine jewelry chain made of precious metal, base metal, or metal alloy, and which may be used by day as an ID card holder in the form of a necklace, bracelet, belt, or watch-type chain, and by night as a piece of decorative jewelry in the form of a necklace, bracelet, belt, or watch-type chain. The chain includes a looped metal clasp that may be used to hold an ID card, a transparent ID card holder, a pendant, or a charm, or to secure the necklace to itself, thus creating a double-stranded "choker" style of necklace. The chain may also be worn in the lapel, draped through belt-loops, or otherwise strung around a portion of clothing or of the body. Decorative charms may also be purchased, with the chain threaded through the charms to create a more unique or individual piece of jewelry. The ID cards and charms strung from the chain may also incorporate embedded chip technology, which would allow for the download and storage of personal security information.

It is apparent that numerous innovations for badge holders have been provided in the prior art, which are adapted to be used. Furthermore, even though these innovations may be suitable for the specific individual purposes to which they address, however, they would not be suitable for the purposes of the embodiments of the present invention as heretofore described, namely, a holder for wearing by a user, slidably, replaceably, and visibly holding an ID card, and replaceably and visibly holding at least one specifically configured charm.

SUMMARY OF THE INVENTION

Thus, it is an object of the embodiments of the present invention to provide a holder for wearing by a user, slidably, replaceably, and visibly holding an ID card, and replaceably and visibly holding at least one specifically configured charm, which avoids the disadvantages of the prior art.

Briefly stated, another object of the embodiments of the present invention is to provide a holder for wearing by a user, slidably, replaceably, and visibly holding an ID card, and replaceably and visibly holding at least one specifically configured charm. The holder includes a frame, a first apparatus allowing the holder to be worn by the user, a second apparatus slidably, replaceably, and visibly holding the ID card, and a third apparatus replaceably and visibly holding the at least one specifically configured charm.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawings.

BRIEF DESCRIPTION OF THE DRAWINGS

The figures of the drawings are briefly described as follows.

LIST OF REFERENCE NUMERALS UTILIZED IN THE DRAWING

A. General

Figure 1:
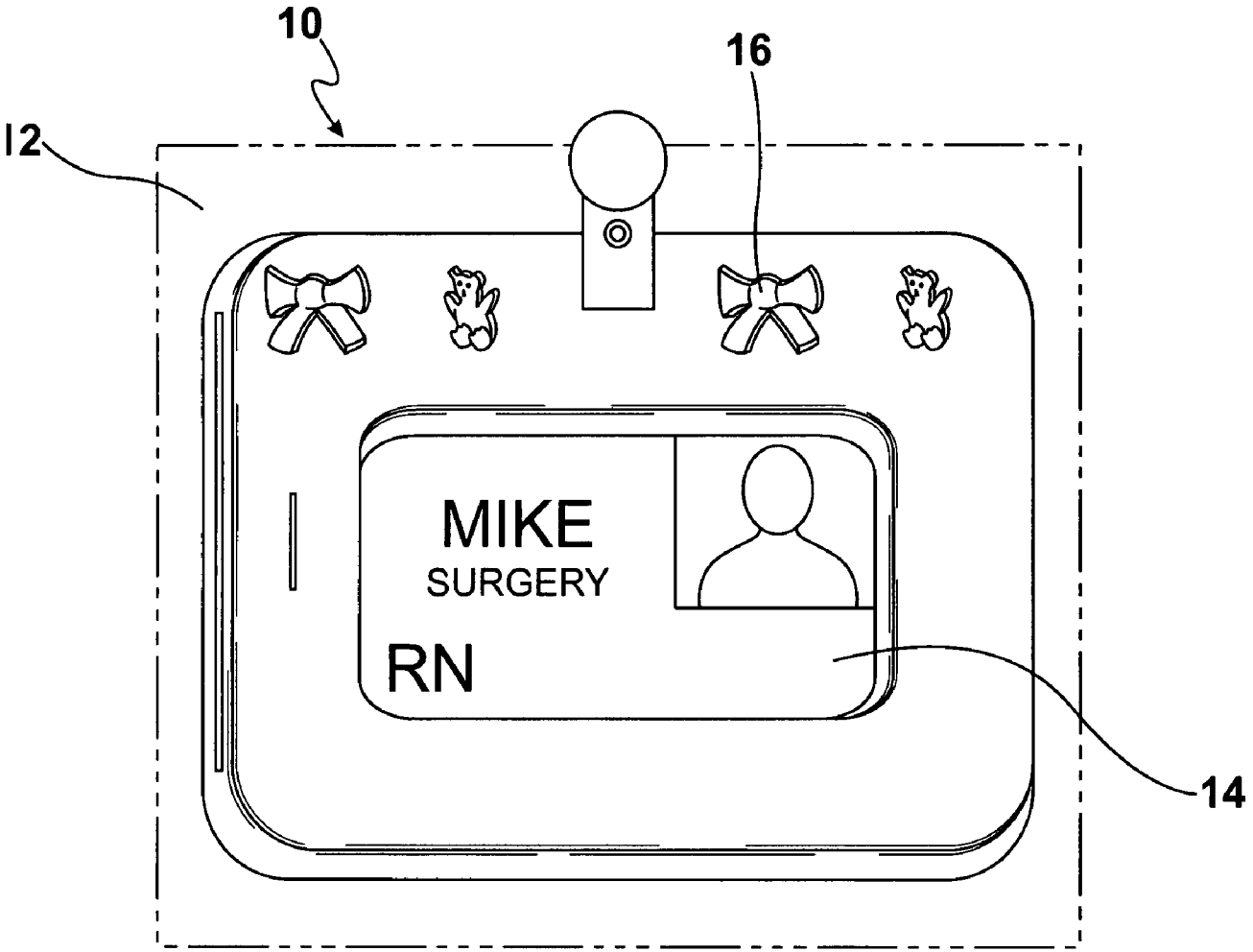
FIG. 1 is a diagrammatic perspective view of the holder of the embodiments of the present invention being worn by a user, slidably, replaceably, and visibly holding an ID card, and replaceably and visibly holding at least one specifically configured charm.

10 holder of embodiments of present invention for wearing by user 12, slidably, replaceably, and visibly holding ID card 14, and replaceably and visibly holding at least one specifically configured charm 16

12 user

14 ID card

16 at least one specifically configured charm

B. Overall Configuration of Holder 10

18 frame

20 first apparatus for allowing holder 10 to be worn by user 12

22 second apparatus for slidably, replaceably, and visibly holding ID card 14

24 third apparatus for replaceably and visibly holding at least one specifically configured charm 16

(1) Specific Configuration of Frame 18.

26 pair of long sides of frame 18

28 pair of short sides of frame 18

30 back face of frame 18

32 front face of frame 18

(2) Specific Configuration of First Apparatus 20.

34 first pair of through slots 34 of frame 18 for receiving clip 36 for clipping holder 10 to user 12

36 clip for clipping holder 10 to user 12

(3) Specific Configuration of Second Apparatus 22.

38 second through slot of frame 18 for receiving ID card 14

40 window of frame 18

42 track of frame 18 for allowing ID card 14 to be slid through second through slot 38 in frame 18 and ride along track 42 in frame 18 until ID card 14 is properly displayed in window 40 of frame 18

(4) Specific Configuration of Third Apparatus 24.

44 plurality of through bores of frame 18 for allowing at least one specifically configured charm 16 to be held replaceably and visibly (5) Specific Configuration of Each at Least One Specifically Configured Charm 16.

46 body of each specifically configured charm of at least one specifically configured charm 16

48 nipple of each specifically configured charm of at least one specifically configured charm 16

50 front face of body 46 of each specifically configured charm of at least one specifically configured charm 16

52 back face of body 46 of each specifically configured charm of at least one specifically configured charm 16

54 bulbous free end of nipple 48 of each specifically configured charm of at least one specifically configured charm 16

DETAILED DESCRIPTION OF THE PREFERRED EMBODIMENTS

A. General

Referring now to the figures, in which like numerals indicate like parts, and particularly to FIG. 1, which is a diagrammatic perspective view of the holder of the embodiments of the present invention being worn by a user, slidably, replaceably, and visibly holding an ID card, and replaceably and visibly holding at least one specifically configured charm, the holder of the embodiments of the present invention is shown generally at 10 for wearing by a user 12, slidably, replaceably, and visibly holding an ID card 14, and replaceably and visibly holding at least one specifically configured charm 16.

B. The Overall Configuration of the Holder 10

Figures 2, 3:
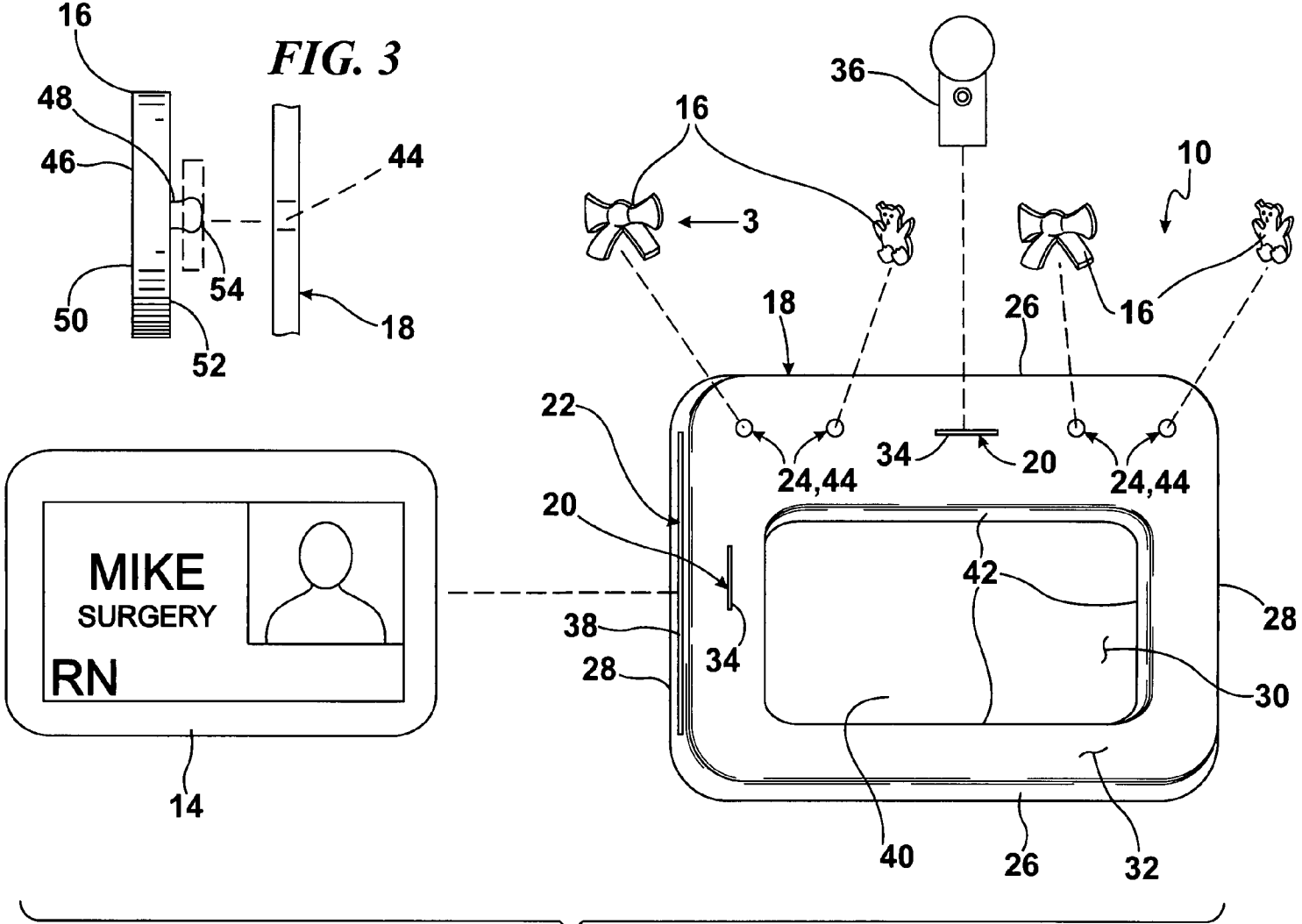
FIG. 2 is an exploded diagrammatic perspective view of the holder of the embodiments of the present invention, the ID card, and the at least one specifically configured charm, shown in FIG. 1.
FIG. 3 is an enlarged diagrammatic side elevational view taken generally in the direction of ARROW 3 in FIG. 2 of one specifically configured charm.

The overall configuration of the holder 10 can best be seen in FIG. 2, which is an exploded diagrammatic perspective view of the holder of the embodiments of the present invention, the ID card, and the at least one specifically configured charm, shown in FIG. 1, and as such, will be discussed with reference thereto.

The holder 10 comprises a frame 18, a first apparatus 20 for allowing the holder 10 to be worn by the user 12, a second apparatus 22 for slidably, replaceably, and visibly holding the ID card 14, and a third apparatus 24 for replaceably and visibly holding the at least one specifically configured charm 16.

(1) The Specific Configuration of the Frame 18.

The frame 18 is flexible, thin, substantially flat, generally rectangularly-shaped, and has a pair of long sides 26, a pair of short sides 28 that are shorter than the pair of long sides 26 of the frame 18, respectively, a back face 30, and a front face 32.

The frame 18 is made of a material selected from the group consisting of rubber and closed cell resin.

(2) The Specific Configuration of the First Apparatus 20.

The first apparatus 20 includes the frame 18 having a first pair of through slots 34 for allowing the holder 10 to be worn by the user 12.

One first through slot 34 extends inwardly of, and in a direction of, one long side 26 of the frame 18 and is for receiving a clip 36 for clipping the holder 10 to the user 12 when the ID card 14 is displayed horizontally.

The other first through slot 34 extends inwardly of, and in a direction of, one short side 28 of the frame 18 and is for receiving the clip 36 for clipping the holder 10 to the user 12 when the ID card 14 is displayed vertically.

(3) The Specific Configuration of the Second Apparatus 22.

The second apparatus 22 includes the frame 18 having a second through slot 38, a window 40, and a track 42 for allowing the ID card 14 to be slidably, replaceably, and visibly held.

The second through slot 38 extends through one short side 28 of the frame 18, and is for receiving the ID card 14.

The window 40 in the frame 18 is cut-out through the front face 32 of the frame 18, and communicates with the second through slot 38 in the frame 18.

The track 42 is generally U-shaped and opens into the second through slot 38 in the frame 18 for allowing the ID card 14 to be slid through the second through slot 38 in the frame 18 and ride along the track 42 in the frame 18 until the ID card 14 is properly displayed in the window 40 of the frame 18.

(4) The Specific Configuration of the Third Apparatus 24.

The third apparatus 24 includes the frame 18 having a plurality of through bores 44 for allowing the at least one specifically configured charm 16 to be held replaceably and visibly.

The plurality of through bores 44 extend inwardly of one long side 26 of the frame 18 and straddle the one first through slot 34 through the frame 18.

(5) The Specific Configuration of Each at Least One Specifically Configured Charm 16.

The specific configuration of each at least one specifically configured charm 16 can best be seen in FIG. 3, which is an enlarged diagrammatic side elevational view taken generally in the direction of ARROW 3 in FIG. 2 of one specifically configured charm, and as such, will be discussed with reference thereto.

Each specifically configured charm 16 is one-piece and includes a body 46 and a nipple 48.

The body 46 of each specifically configured charm 16 is thin, and has a front face 50 and a back face 52.

The nipple 48 of each specifically configured charm 16 extends axially from the back face 52 of the body 46 of an associated specifically configured charm 16 and terminates in a bulbous free end 54. The bulbous free end 54 of the nipple 48 of each specifically configured charm 16 can be disk-shaped (shown in phantom in FIG. 3), and is resiliently received within an associated second through bore 44 in the frame 18, sort of popped-in, so as to allow the front face 50 of the body 46 of each specifically configured charm 16 to be displayed.

C. The Conclusions

It will be understood that each of the elements described above or two or more together may also find a useful application in other types of constructions differing from the types described above.

While the embodiments of the present invention have been illustrated and described as embodied in a holder for wearing by a user, slidably and replaceably holding an ID card, and replaceably and visibly holding at least one specifically configured charm, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features from the standpoint of prior art fairly constitute characteristics of the generic or specific aspects of the embodiments of the present invention.

The invention claimed is:

1. A holder for wearing by a user, slidably, replaceably, and visibly holding an ID card, and replaceably and visibly holding at least one specifically configured charm, comprising:

a) a frame;

b) first means for allowing said holder to be worn by the user;

c) second means for slidably, replaceably, and visibly holding the ID card; and d) third means for replaceably and visibly holding the at least one specifically configured charm;

wherein said frame is flexible;

wherein said frame is thin;

wherein said frame is substantially flat;

wherein said frame is generally rectangularly-shaped;

wherein said frame has:

a) a pair of long sides;

b) a pair of short sides;

a back face; and d) a front face;

wherein said pair of short sides of said frame are shorter than said pair of long sides of said frame, respectively;

wherein said first means includes said frame having a first pair of through slots for allowing wearing of said holder by the user;

wherein one first through slot extends inwardly of one long side of said frame;

wherein said one first through slot extends in a direction of said one long side of said frame;

wherein said one first through slot is for receiving a clip;

wherein the clip is for clipping said holder to the user when the ID card is displayed horizontally;

wherein said third means includes said frame having a plurality of through bores;

wherein said plurality of through bores of said frame are for allowing the at least one specifically configured charm to be replaceably held;

wherein said plurality of through bores of said frame are for allowing the at least one specifically configured charm to be visibly held;

wherein the other first through slot extends inwardly of one short side of said frame;

wherein said other first through slot extends in a direction of said one short side of said frame;

wherein said other first through slot is for receiving a clip;

wherein the clip is for clipping said holder to the user when the ID card is displayed vertically;

wherein said second means includes said frame having:

a) a second through slot;

b) a window; and c) a track;

wherein said second through slot of said frame, said window of said frame, and said track of said frame are for allowing the ID card to be slidably held;

wherein said second through slot of said frame, said window of said frame, and said track of said frame are for allowing the ID card to be replaceably held;

wherein said second through slot of said frame, said window of said frame, and said track of said frame are for allowing the ID card to be visibly held;

wherein said second through slot extends through one short side of said frame;

wherein said second through slot of said frame is for receiving the ID card;

wherein said window is a cut-out through said front face of said frame; and wherein said window communicates with said second through slot in said frame.

2. The holder of claim 1, wherein said track of said frame is generally U-shaped; and wherein said track of said frame opens into said second through slot in said frame for allowing said ID card to be slid through said second through slot in said frame and ride along said track in said frame until the ID card is properly displayed in said window of said frame.

3. The holder of claim 1, wherein said plurality of through bores extend inwardly of one long side of said frame; and wherein said plurality of through bores straddle said one first through slot of said frame.

4. The holder of claim 1, wherein each specifically configured charm is one-piece; and wherein each specifically configured charm includes:

a) a body; and b) a nipple.

5. The holder of claim 4, wherein said body of each specifically configured charm is thin; and wherein said body of each specifically configured charm has:

a) a front face; and b) a back face.

6. The holder of claim 5, wherein said nipple of each specifically configured charm extends axially from said back face of said body of an associated specifically configured charm; and wherein said nipple of each specifically configured charm terminates in a bulbous free end.

7. The holder of claim 6, wherein said bulbous free end of said nipple of each specifically configured charm is resiliently received within an associated second through bore in said frame so as to allow said front face of said body of each specifically configured charm to be displayed.

8. The holder of claim 6, wherein said bulbous free end of said nipple of each specifically configured charm is disk-shaped.

9. The holder of claim 1, wherein said frame is made of a material selected from the group consisting of rubber and closed cell resin.

* * * * *